US007474271B2

(12) United States Patent
Nagano et al.

(10) Patent No.: US 7,474,271 B2
(45) Date of Patent: Jan. 6, 2009

(54) FEEDHORN, RADIO WAVE RECEIVING CONVERTER AND ANTENNA

(75) Inventors: Atsushi Nagano, Osaka (JP); Yosuke Okabe, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/003,342

(22) Filed: Dec. 6, 2004

(65) Prior Publication Data

US 2005/0140560 A1 Jun. 30, 2005

(30) Foreign Application Priority Data

Dec. 26, 2003 (JP) ..... 2003-433373

(51) Int. Cl.
*H01Q 13/00* (2006.01)

(52) U.S. Cl. ..... 343/786

(58) Field of Classification Search ..... 343/776, 343/786, 785, 772, 872

See application file for complete search history.

(56) References Cited

U.S. PATENT DOCUMENTS

| | | | | |
|---|---|---|---|---|
| 4,498,061 | A * | 2/1985 | Morz et al. | 333/21 A |
| 4,783,665 | A * | 11/1988 | Lier et al. | 343/786 |
| 5,642,121 | A * | 6/1997 | Martek et al. | 343/786 |
| 6,700,548 | B1 * | 3/2004 | Chen et al. | 343/771 |
| 2003/0058181 | A1 | 3/2003 | Sasaki et al. | |
| 2003/0058183 | A1 | 3/2003 | Nakagawa et al. | |
| 2003/0068980 | A1 | 4/2003 | Nakagawa et al. | |

FOREIGN PATENT DOCUMENTS

| | | |
|---|---|---|
| CN | 2159614 | 3/1994 |
| JP | 02-272901 | 11/1990 |
| JP | 03-029503 | 2/1991 |
| JP | 04-185105 | 7/1992 |
| JP | 04-326604 | 11/1992 |
| JP | 04-326605 | 11/1992 |
| JP | 09-174596 | 7/1997 |
| JP | 2001-217644 A | 8/2001 |
| JP | 2003-101305 | 4/2003 |
| JP | 2003-101306 | 4/2003 |
| JP | 2003-101330 | 4/2003 |
| JP | 2003-101420 | 4/2003 |
| JP | 2003-304116 A | 10/2003 |
| WO | 99-10950 | 3/1999 |

OTHER PUBLICATIONS

U.S. Appl. No. 10/901,056, filed Jul. 29, 2004 entitled "Feedhorn, Radio Wave Receiving Converter and Antenna".

Office Action dated Dec. 21, 2007 in Chinese Application 20041010463.14 and English-language translation.

* cited by examiner

*Primary Examiner*—Michael C Wimer
(74) *Attorney, Agent, or Firm*—Nixon & Vanderhye PC

(57) ABSTRACT

A dielectric feedhorn as a feedhorn according to the present invention, with which a feedhorn, a radio wave receiving converter and an antenna capable of suppressing an increase in manufacturing costs can be obtained, includes a chassis body including a waveguide having an opening, and a dielectric member. The dielectric member is connected to the opening of the waveguide, and constituted by dielectrics as a plurality of members.

15 Claims, 10 Drawing Sheets

FEEDHORN, RADIO WAVE RECEIVING CONVERTER AND ANTENNA

This nonprovisional application is based on Japanese Patent Application No. 2003-433373 filed with the Japan Patent Office on Dec. 26, 2003, the entire contents of which are hereby incorporated by reference.

BACKGROUND OF THE INVENTION

1. Field of the Invention

The present invention relates to a feedhorn, a radio wave receiving converter and an antenna, and particularly, to a feedhorn including a dielectric, a radio wave receiving converter and an antenna.

2. Description of the Background Art

Conventionally, an antenna for receiving a radio wave of satellite broadcasting or the like is known. To the antenna, a radio wave receiving converter is arranged. As a member constituting the radio wave receiving converter, a feedhorn in which a dielectric is connected to an open end of a waveguide is known (for example, see Japanese Patent Laying-Open No. 2001-217644).

According to Japanese Patent Laying-Open No. 2001-217644, a dielectric member constituted by a thick dielectric is fixedly connected to an open end of a waveguide. Such a dielectric member is manufactured using injection molding or the like.

However, the aforementioned dielectric member formed of a thick dielectric involves a problem that, when performing injection molding, a concave portion (a sinkmark generating portion) is generated at the outer portion thereof, or a bubble is generated in the inner portion thereof. Generation of such a concave portion or a bubble deteriorates the dimensional precision of the dielectric member.

Additionally, generation of such a concave portion or a bubble in the dielectric member also involves a problem that the radiation pattern characteristics of a feedhorn using the dielectric member is distorted (the radiation pattern characteristics deviate from the designed characteristics). As a result, the dielectric member with a concave portion or a bubble is treated as a defective, and thus becomes a cause of reducing yield of the dielectric member. Additionally, since a step of screening such a defective is required, the manufacturing period is prolonged. As a consequence, it has been one cause of increasing the manufacturing costs of the dielectric member (and hence, the feedhorn).

SUMMARY OF THE INVENTION

An object of the present invention is to provide a feedhorn, a radio wave receiving converter and an antenna that can suppress an increase in manufacturing costs.

A feedhorn according to the present invention includes: a chassis body including a waveguide having an opening; and a dielectric member. The dielectric member is connected to the opening of the waveguide, and constituted by a plurality of members.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
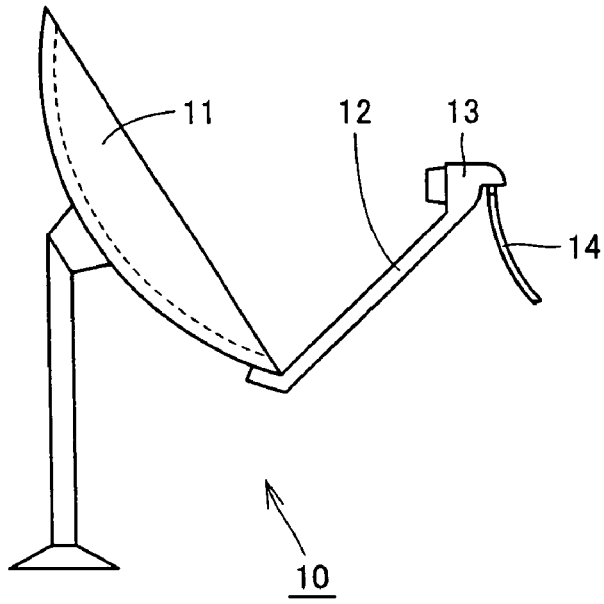
FIG. 1 is a schematic illustration showing a first embodiment of a radio wave receiving antenna for satellite broadcasting or the like according to the present invention.

In the following, embodiments of the present invention will be described based on the drawings. Throughout the figures, the same or corresponding parts are given the same reference characters, and the description thereof will not be repeated.

First Embodiment

Figure 2:
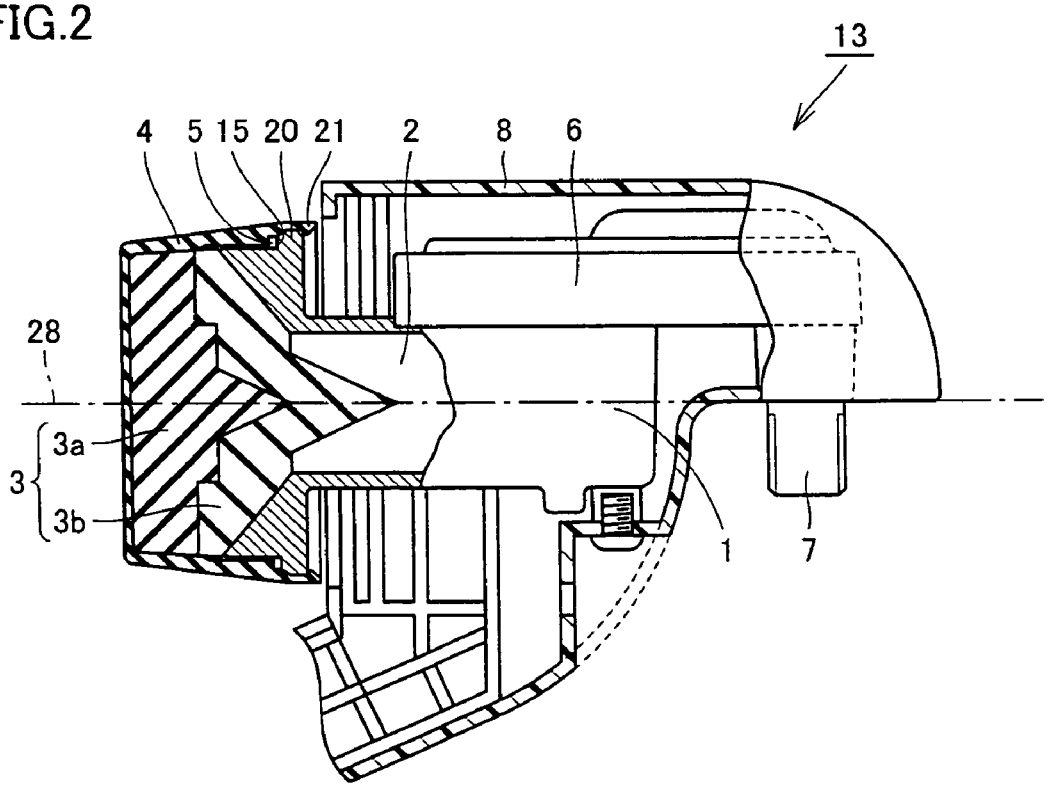
FIG. 2 is a schematic illustration showing a radio wave receiving converter used in the antenna shown in FIG. 1.
Figure 3:
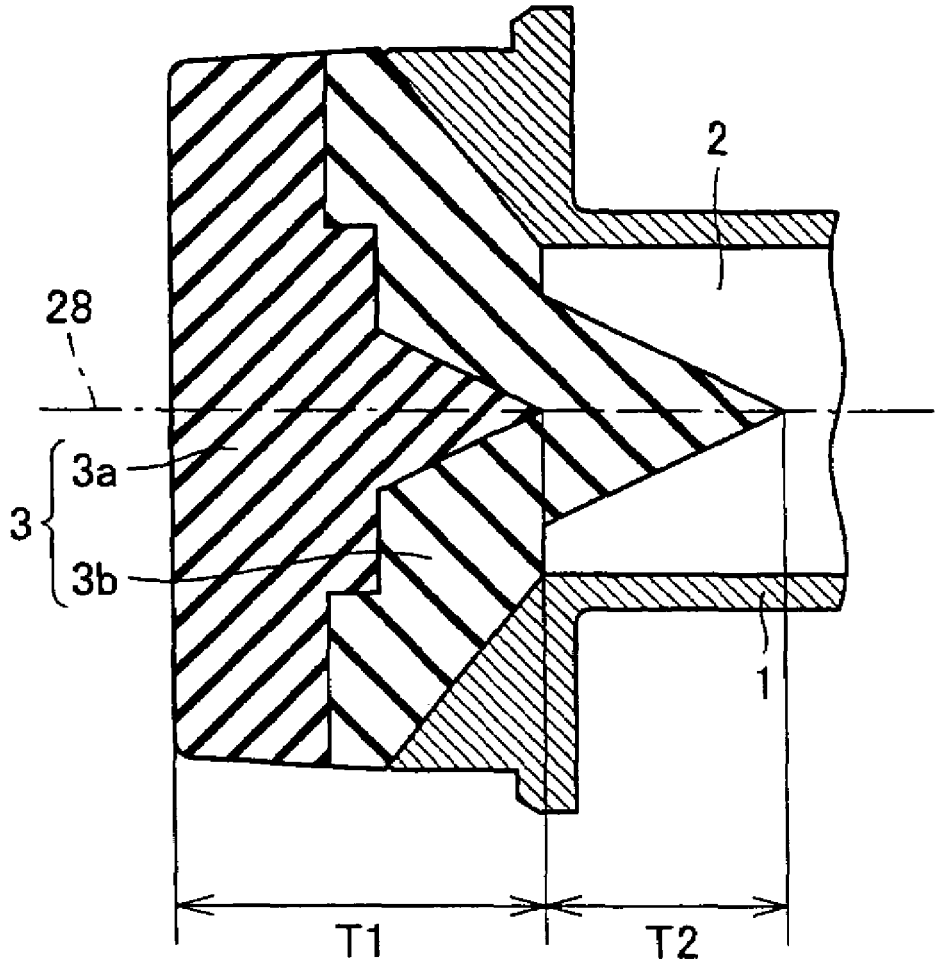
FIG. 3 is a partial cross-sectional illustration showing a front portion of a dielectric feedhorn in the converter shown in FIG. 2.

Referring to FIGS. 1-3, a converter including a dielectric feedhorn and a radio wave receiving antenna (hereafter also referred to as an antenna) according to the present invention will be described.

As shown in FIG. 1, an antenna 10 according to the present invention includes a parabolic portion 11 for reflecting a radio wave, an arm 12 connected to parabolic portion 11, and a converter 13 arranged at the tip of arm 12 for receiving the radio wave. To converter 13, a cable 14 is connected for transmitting the received radio wave (a signal) to other devices such as a tuner or a BS receiver. As this cable 14, for example a coaxial cable can be used. To the back side of parabolic portion 11, a support arm, which is a fixing support member for fixedly arranging antenna 10 in a prescribed position, is mounted.

As shown in FIG. 2, converter 13 is formed of chassis body 1, a circuitry portion 6 connected to chassis body 1, a dielectric member 3 arranged to close an opening (front open end) of a waveguide 2 provided to chassis body 1, a waterproof cover 4 covering dielectric member 3 and connected to chassis body 1, and an exterior cabinet 8 as an exterior member covering chassis body 1 and circuitry portion 6. The lower portion of exterior cabinet 8 is connected to the tip of arm 12 shown in FIG. 1. Further, to circuitry portion 6, an output terminal 7 for connecting cable 14 shown in FIG. 1 is formed.

At the rear end of waterproof cover 4 (the end on chassis body 1 side), a nail portion 21 that is a convex portion protruding toward internal circumferential side of waterproof cover 4 is formed. In chassis body 1, to a portion of a sidewall (a side face) facing to the rear end of waterproof cover 4, a flange portion 20 that is a portion protruding toward the outside (the direction away from a center axis 28) is formed. By nail portion 21 of waterproof cover 4 and flange portion 20 of chassis body 1 mating with each other, waterproof cover 4 is fixed to chassis body 1.

Additionally, dielectric member 3 is pushed toward the chassis body 1 side by waterproof cover 4. As a result, dielectric member 3 is fixed in a state tightly attached to the front open end of waveguide 2 of chassis body 1. It is noted that, while nail portion 21 may be formed on the entire circumference of the rear end of waterproof cover 4, it may be formed at a plurality of locations (for example, at two locations, or at three or more locations) in the rear end. In this case, it is preferable that a plurality of nail portions 21 are formed at regular intervals in the circumferential direction of the rear end of waterproof cover 4. Further, while flange portion 20 of chassis body 1 may be formed on the entire circumference of the sidewall of chassis body 1, it may be formed only at locations facing to nail portions 21 of waterproof cover 4 when they are formed at a plurality of locations.

In front of flange portion 20 (in flange portion 20, on a sidewall side positioned opposite to the sidewall to which the protrusion of nail portion 21 of dielectric member 3 contacts) of chassis body 1, a groove 15 is formed at the entire circumference of the sidewall of chassis body 1. A ring packing 5 is inserted in this groove 15. As shown in FIG. 2, in a state where waterproof cover 4 is fixedly connected to chassis body 1, ring packing 5 is tightly attached to each of the internal circumferential face of waterproof cover 4 and the internal circumferential face of groove 15 of chassis body 1. As a result, the internal space enclosed by chassis body 1 and waterproof cover 4 (the space where dielectric member 3 is arranged) can be separated from the space outside of converter 13 by ring packing 5. Thus, excellent airtightness of the space where dielectric member 3 is arranged can be maintained.

Next, referring to FIG. 3, the dielectric feedhorn of converter 13 will be described in more detail. Dielectric member 3 is formed of two members, i.e., a dielectric 3*b* arranged on chassis body 1 side, and a dielectric 3*a* arranged so as to overlap with this dielectric 3*b*. In dielectric 3*a*, the surface shape of the portion facing to dielectric 3*b* is in a shape conforming to the shape of the portion of dielectric 3*b* that faces to dielectric 3*a*. In other words, dielectric 3*a* and dielectric 3*b* can be brought in a state in which the surfaces of respective portions facing to each other are substantially in contact (in a state contacting to each other with a gap hardly interposed therebetween). These two dielectrics 3*a* and 3*b* are each independent members, and as shown in FIG. 2, they are fixed in a state being pushed toward the chassis body 1 side by waterproof cover 4 being fixed to chassis body 1. The shape of dielectric member 3 is determined such that it attains a radiation pattern conforming to an angular aperture of antenna 10 (see FIG. 1). It is preferable that waterproof cover 4 arranged so as to be tightly attached to the external circumferential face of dielectric member 3 is formed with a weatherproof material having the electric characteristics similar to dielectric member 3. It is noted that the aforementioned electric characteristics specifically mean permittivity and dielectric loss tangent.

Dielectric member 3 is separated into two parts of dielectrics 3*a* and 3*b* in order to improve injection moldability of dielectric member 3, so that the manufacture thereof is facilitated. Specifically, by separating dielectric member 3 into two parts, such as dielectrics 3*a* and 3*b*, dielectrics 3*a* and 3*b* can each relatively be thin (prevented from being thick). Here, when dielectric member 3 is separated into two members of dielectrics 3*a* and 3*b* as shown in FIG. 2 (or into a plurality of members of three or more), in order to improve injection moldability of dielectric member 3, the shape or dimension of dielectrics 3*a* and 3*b* are determined so that maximum thicknesses T1 and T2 of dielectrics 3*a* and 3*b*, which are the members constituting dielectric member 3, each attain at most a prescribed value.

For example, in case of dielectric member 3 constituting a dielectric feedhorn for receiving a radio wave of 12 GHz band, it is preferable to set respective maximum thicknesses T1 and T2 of dielectrics 3*a* and 3*b* to at most approximately 8 mm. Thus, by setting maximum thicknesses T1 and T2 to at most 8 mm, even when bubbles are generated in dielectrics 3*a* and 3*b* in the injection molding step for forming dielectrics 3*a* and 3*b*, the diameter of the bubble will be at most approximately 4 mm. Thus, such a problem is prevented that the electric characteristics of the dielectric member extremely deteriorate. It should be noted that, values of maximum thicknesses T1 and T2, the shape or dimension of dielectrics 3*a* and 3*b* and the like may appropriately be selected in accordance with the band of receiving radio wave, characteristics required to the antenna and the like.

When using dielectrics 3*a* and 3*b* of the shape as shown in FIG. 3, maximum thicknesses T1 and T2 are the thicknesses at the center portions of dielectrics 3*a* and 3*b*, respectively (when dielectric member 3 is arranged to cover the opening of waveguide 2, the thicknesses at positions overlapping with center axis 28 of waveguide 2). The maximum thicknesses, however, may be determined at other portions depending on the shape of dielectrics 3*a* and 3*b*.

Materials constituting dielectrics 3*a* and 3*b* may be the same, or they may be different. In this case, the materials of dielectrics 3*a* and 3*b* may appropriately be selected so as to conform to the electric characteristics required to dielectric member 3.

Next, an operation of converter 13 is briefly described. A radio wave reflected from parabolic portion 11 for reflecting a radio wave shown in FIG. 1 enters waveguide 2 from the front of converter 13 (i.e., as seen from chassis body 1, from the side where dielectric member 3 is arranged) through waterproof cover 4 and dielectric member 3. The radio wave (signal) that entered waveguide 2 is transmitted to circuitry portion 6 connected to chassis body 1. In this circuitry portion 6, the transmitted signal is amplified and the frequency of the signal is further converted to a prescribed intermediate frequency. The signal of which frequency has been converted is output from an output terminal 7 to an external device (such as a tuner) via cable 14.

Antenna 10 and converter 13 according to the present invention as shown in FIGS. 1-3 basically show the same electric characteristics as in the case where a dielectric formed of one member as dielectric member 3 is used. In the following, this will specifically be described.

Figure 14:
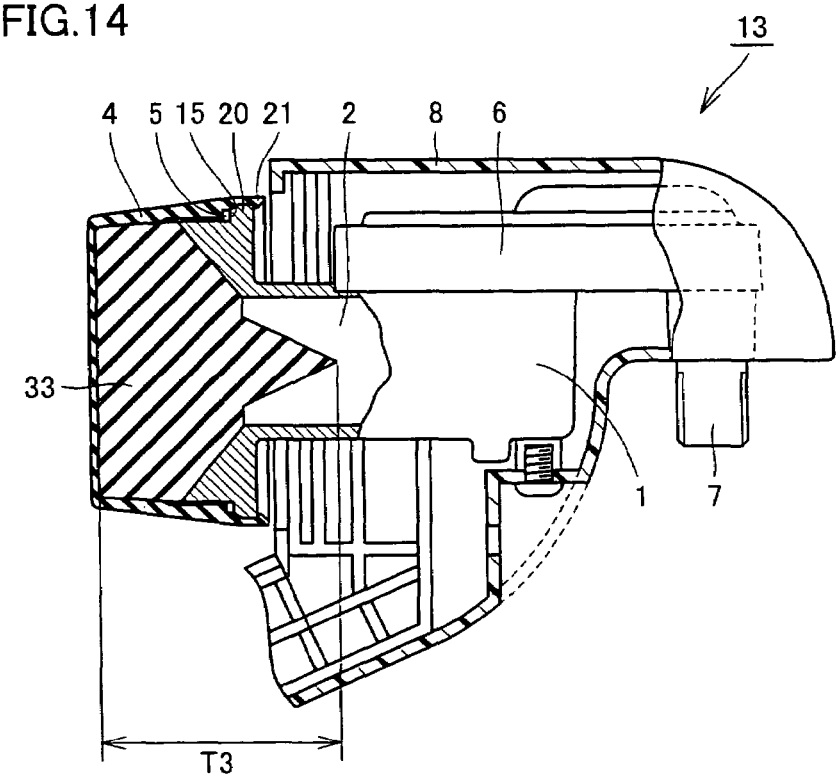
FIG. 14 is a schematic illustration showing a converter as a comparative example for describing an effect of the antenna and the converter shown in FIGS. 1-3.

Converter 13 shown in FIG. 14 as a comparative example basically has the same structure as converter 13 shown in FIGS. 1-3 except that dielectric member 33 is formed of one member.

Figure 4:
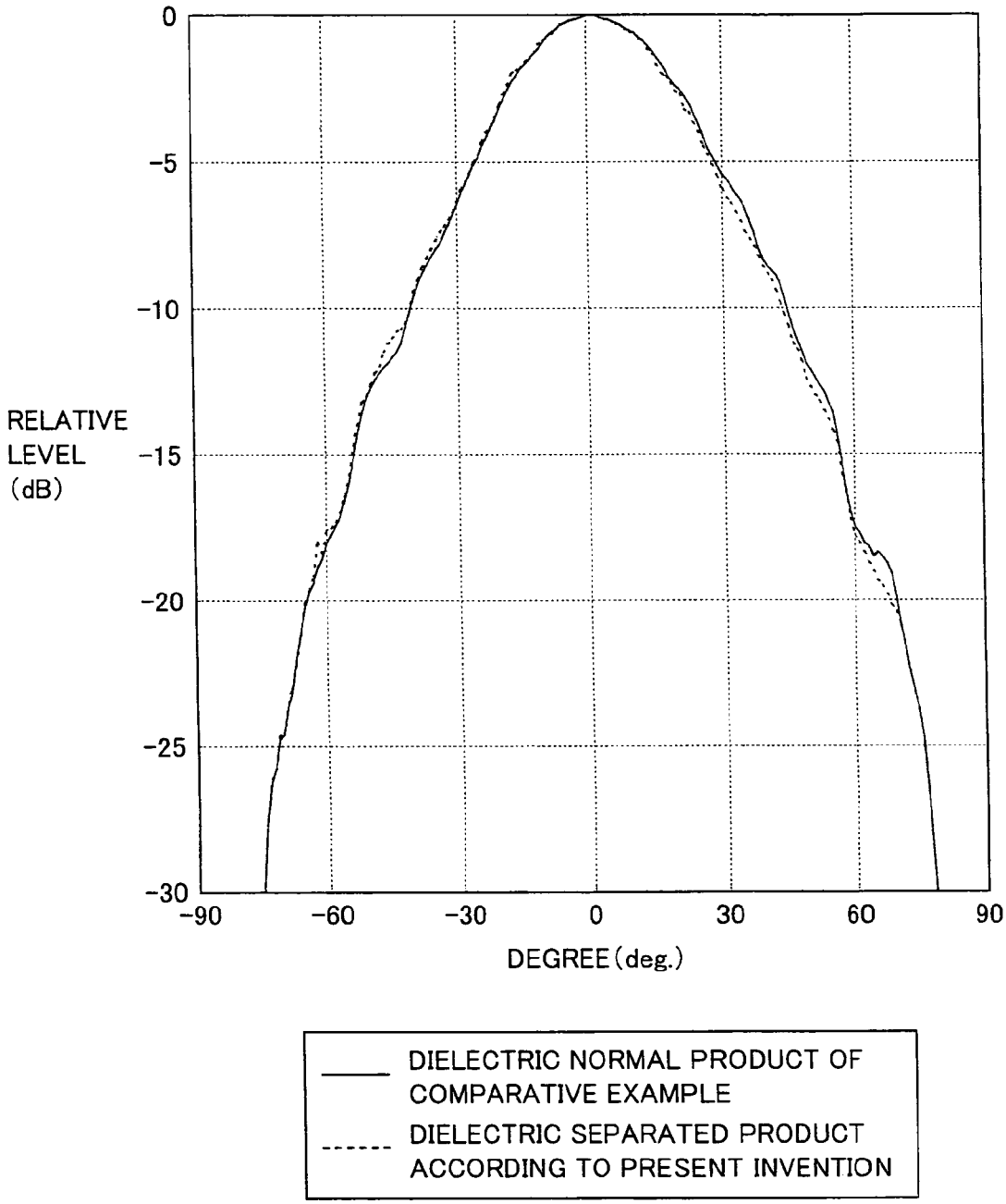
FIG. 4 is a graph showing radiation pattern characteristics of a sample of the converter.

As to converter 13 of antenna 10 according to the present invention shown in FIGS. 1-3 and as to converter 13 as a comparative example shown in FIG. 14, respective samples each having a structure as illustrated were prepared, and the radiation pattern characteristics thereof were measured. The result is shown in FIG. 4. In FIG. 4, abscissa indicates degree (unit: deg.), while ordinate indicates relative level (unit: dB).

As can be seen from FIG. 4, converter 13 in which dielectric member 33 formed of a single material as shown in FIG. 14 is used (a dielectric normal product of the comparative example) and converter 13 in which dielectric member 3 constituted by a combination of a plurality of members as shown in FIGS. 1-3 is used (a dielectric separated product of the present invention) exhibit almost equivalent radiation pattern characteristics.

Figure 15:
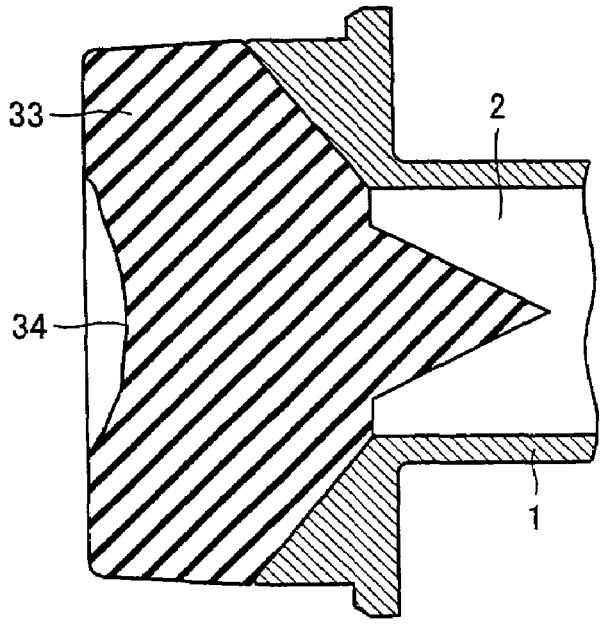
FIG. 15 is a partial cross-sectional illustration for describing a problem that occurs in a dielectric member used in the converter shown in FIG. 14.

Thus, when dielectric member 3 according to the present invention constituted by a plurality of members (dielectrics 3*a* and 3*b*) (see FIG. 2) is used, and when dielectric member 33 constituted by one member as shown in FIG. 14 is used, almost equivalent radiation pattern characteristics are attained. Converter 13 of the comparative example as shown in FIG. 14 involves a problem described below. Specifically, in converter 13 of the comparative example shown in FIG. 14, as dielectric member 33 is a single member, a thickness T3 thereof sometimes becomes very thick (a thick portion that is relatively thick is formed). In such a case, formation of dielectric member 33 using injection molding or the like sometimes resulted in poor injection moldability. As a result, such a problem has been invited that, for example, a concave portion 34 (a sinkmark generating portion) is generated on the surface of dielectric member 33 as shown in FIG. 15, or a bubble 35 is generated inside dielectric member 33 as shown in FIG. 16.

Figure 16:
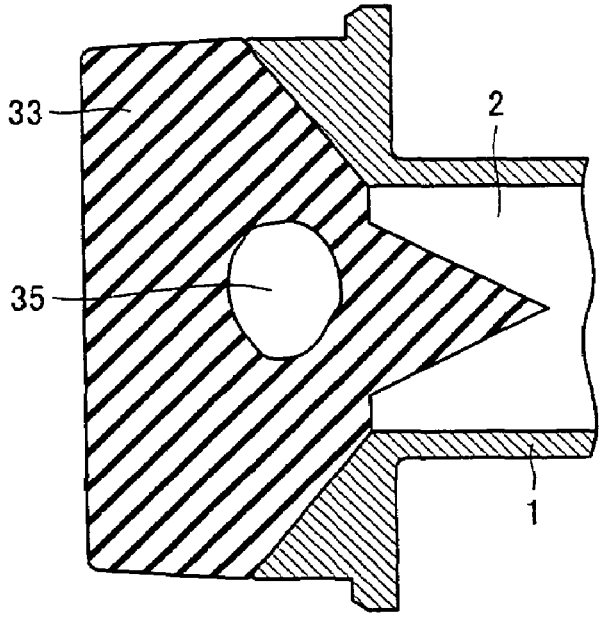
FIG. 16 is a partial cross-sectional illustration for describing a problem that occurs in the dielectric member used in the converter shown in FIG. 14.

As above, constituting dielectric member 33 by a single member as shown in FIG. 14, it has been difficult to form dielectric member 33 having high dimensional precision due to generation of concave portion 34 (see FIG. 15) or bubble 35 (see FIG. 16). Additionally, generation of concave portion 34 or bubble 35 as shown in FIGS. 15 and 16 also involves a problem that radiation pattern characteristics of converter 13 in which dielectric member 33 is used are distorted. This will be described in more detail referring to FIG. 17.

Figure 17:
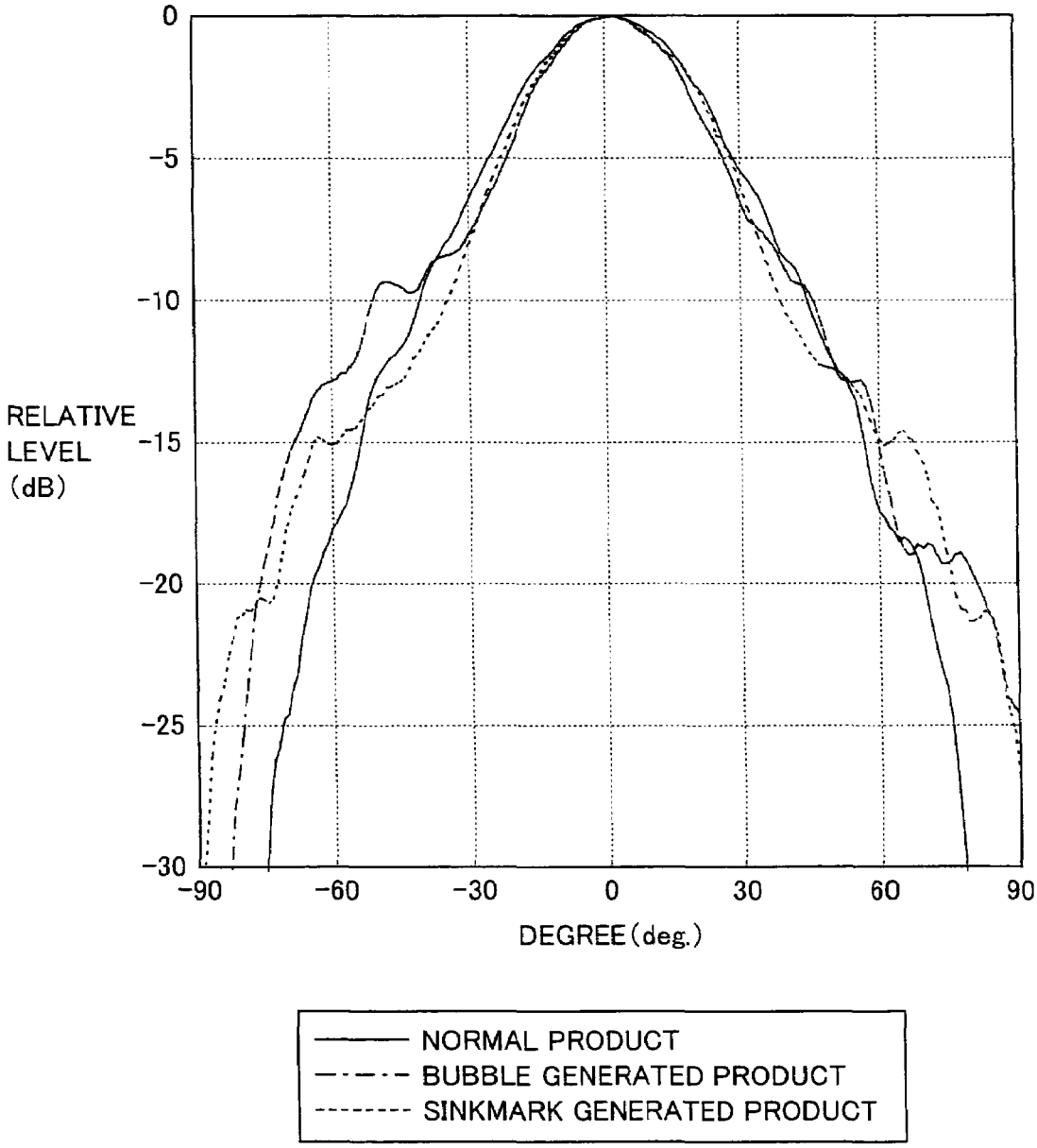
FIG. 17 is a graph showing radiation pattern characteristics for describing a problem that occurs in a converter as a comparative example shown in FIG. 14.

Referring to FIG. 17, abscissa indicates degree (unit: deg.), while ordinate indicates relative level (unit: dB). As can be seen from FIG. 17, as compared to the radiation pattern characteristics of a normal product (converter 13 in which dielectric member 33 having a shape exactly designed as shown in FIG. 14 is used) without bubble 35 (see FIG. 16) or concave portion 34 (see FIG. 15), the radiation pattern characteristics of the converter in which dielectric member 33 with concave portion 34 as shown in FIG. 15 (a sinkmark generated product) is used, and the radiation pattern characteristics of the converter in which dielectric member 33 with bubble 35 shown in FIG. 16 (a bubble generated product) is used, are distorted. Thus, as the radiation pattern characteristics are distorted when a bubble generated product or a sinkmark generated product is used, with an antenna in which the converter of such a bubble generated product or a sinkmark generated product is used, the gain of the antenna is disadvantageously reduced. Therefore, dielectric member 33 with concave portion 34 (sinkmark) or bubble 35 as shown in FIGS. 15 and 16 must be excluded as a defective. As a result, a screening step for excluding defectives is required and the yield is reduced, and hence, the manufacturing costs of the antenna in which converter 13 shown in FIG. 14 is used increases.

On the other hand, in converter 13 according to the present invention shown in FIGS. 1-3, the maximum thicknesses of dielectrics 3*a* and 3*b* can be made relatively small by separating dielectric member 3 into two members of dielectrics 3*a* and 3*b* (formation of a thick portion such as dielectric member 33 shown in FIG. 14 can be avoided). Consequently, injection moldability of dielectrics 3*a* and 3*b* can be improved. Accordingly, probability of occurrence of concave portion 34 (sinkmark) or bubble 35 as shown in FIGS. 15 and 16 in dielectric member 3 can be reduced. As a result, yield of dielectric member 3 can be improved, and consequently the manufacturing costs of the antenna can be reduced.

Figure 5:
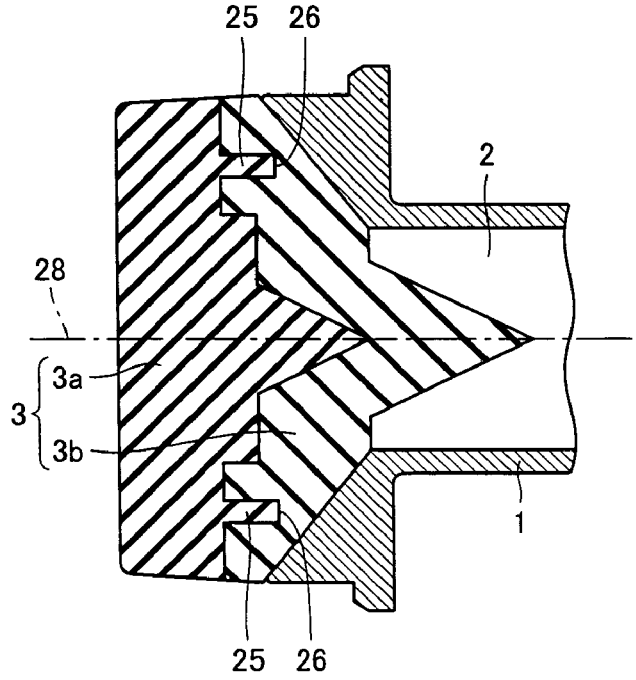
FIG. 5 is a partial cross-sectional illustration showing a front portion of a dielectric feedhorn of a first modification of the converter shown in FIGS. 1-3.

Referring to FIG. 5, a converter as a first modification of the first embodiment of the present invention will be described. FIG. 5 corresponds to FIG. 3.

While the converter including a dielectric feedhorn shown in FIG. 5 basically has the same structure as converter 13 of the antenna shown in FIGS. 1-3, they are different in the connection method of dielectrics 3*a* and 3*b*. Specifically, a convex portion 25 that is a press-fit pin is formed at dielectric 3*a*, and a concave portion 26 for fixedly inserting convex portion 25 is formed at dielectric 3*b* in a portion facing to convex portion 25. As convex portion 25, a press-fit pin of a cylindrical shape is formed, for example. When such a cylindrical press-fit pin is formed, a circular hole of which opening is circular is formed as the corresponding concave portion 26.

Figure 6:
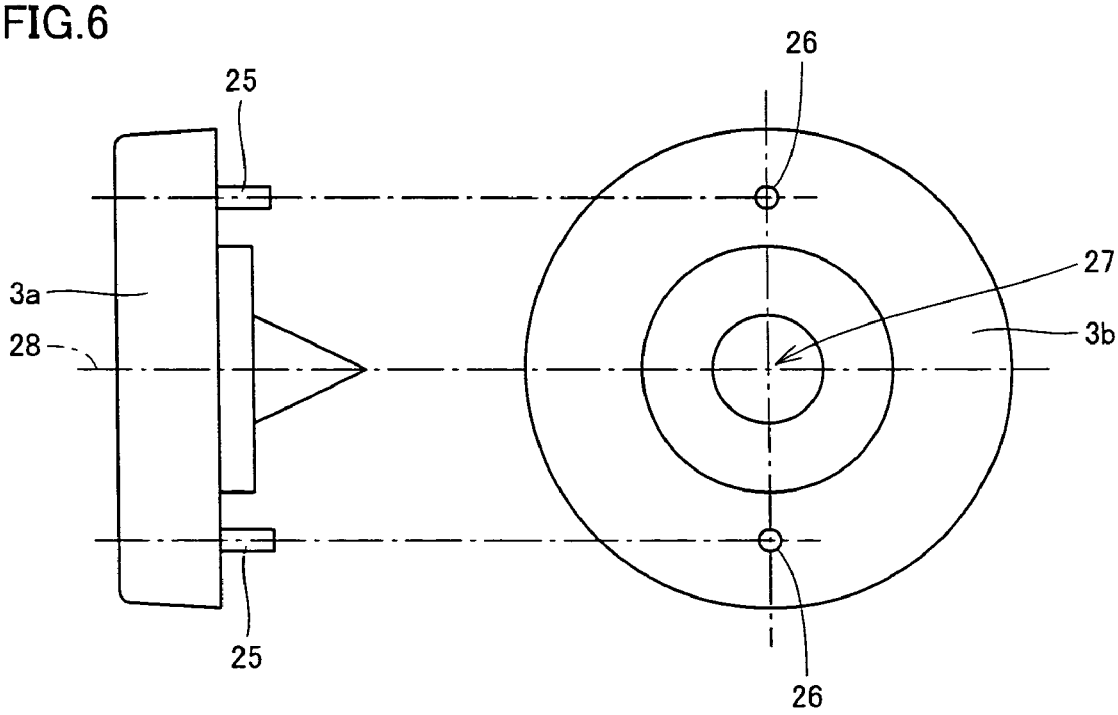
FIG. 6 is an exploded schematic illustration for describing a structure of a dielectric member shown in FIG. 5.

The arrangement and the number of convex portion 25 and concave portion 26 shown in FIG. 5 can arbitrarily be determined. For example, as shown in FIG. 6, in dielectric 3*a*, two convex portions 25 may be formed at symmetric positions relative to center axis 28 of dielectric 3*a*. In dielectric 3*b*, two concave portions 26 may be formed at symmetric positions as seen from center 27 overlapping with center axis 28 in dielectric 3*b*.

Figure 7:
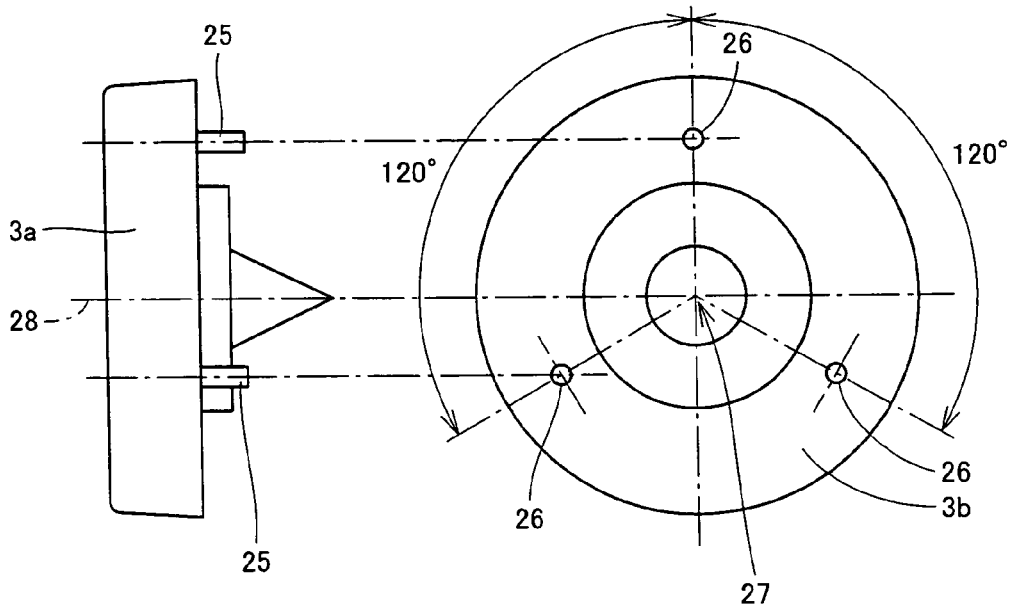
FIG. 7 is an exploded schematic illustration showing a modification of an arrangement of a set of a convex portion and a concave portion of a dielectric shown in FIG. 6.

The arrangement and the number of convex portion 25 and concave portion 26 can arbitrarily be determined and not limited to the arrangement shown in FIG. 6. For example, as shown in FIG. 7, in dielectric 3*a*, on a face facing to dielectric 3*b*, three convex portions 25 are formed at point symmetrical positions around center axis 28 of dielectric 3*a*. In dielectric 3*b*, three concave portions 26 are formed so that the degree of 120° is attained with center 27 between adjacent concave portions 26 being the vertex (in point symmetrical positions around center 27). Thus, three sets of convex portions 25 and concave portions 26 may be formed.

Figure 8:
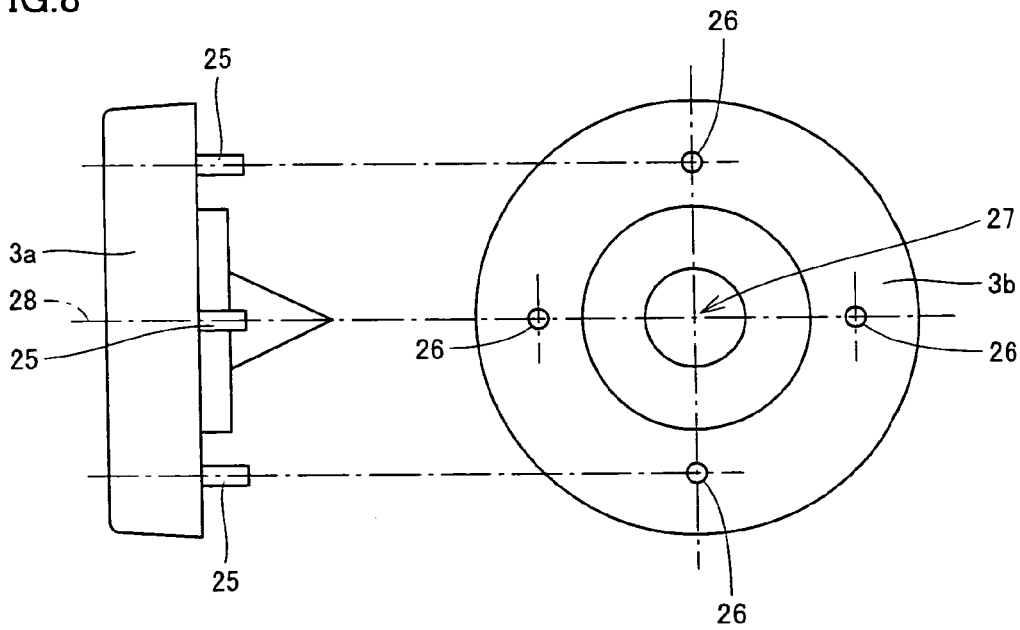
FIG. 8 is an exploded schematic illustration showing a modification of an arrangement of a set of a convex portion and a concave portion of the dielectric shown in FIG. 6.

Additionally, as shown in FIG. 8, four sets of convex portions 25 and concave portions 26 may be formed. In FIG. 8, in dielectric 3*a*, four convex portions 25 are arranged in point symmetrical positions around center axis 28. In dielectric 3*b*, four concave portions 26 are arranged in point symmetrical positions as seen from center 27.

While convex portions 25 are formed on dielectric 3*a* side and concave portions 26 are formed on dielectric 3*b* side in FIGS. 5-8, conversely, concave portions 26 may be formed on dielectric 3*a* side and convex portions 25 may be formed on dielectric 3*b* side. As for the shape of convex portion 25, any shape may be employed besides cylindrical shape as shown in FIGS. 6-8. For example, convex portion 25 may be a prismatic shape (for example, a quadrangular prism or a hexagonal prism). As for the shape of concave portion 26, any shape may be employed as long as it conforms to the shape of convex portion 25. The dimension of concave portion 26 is determined such that convex portion 25 can fixedly be inserted therein.

As above, dielectrics 3*a* and 3*b* are fixed to each other using convex portion 25 and concave portion 26, positional displacement of dielectrics 3*a* and 3*b* can be reduced. Further, by press-fitting convex portion 25 into concave portion 26, the connection strength between dielectrics 3*a* and 3*b* can be maintained sufficiently high. Still further, as a relatively simple structure is attained, an increase in the manufacturing costs of dielectric member 3 can be suppressed. It should be noted that, in the structure of the connection portion shown in FIGS. 5-8, when convex portion 25 is in a cylindrical shape, the diameter of that cylindrical convex portion may be approximately 3 mm, and the length thereof may be approximately 5 mm.

Figure 9:
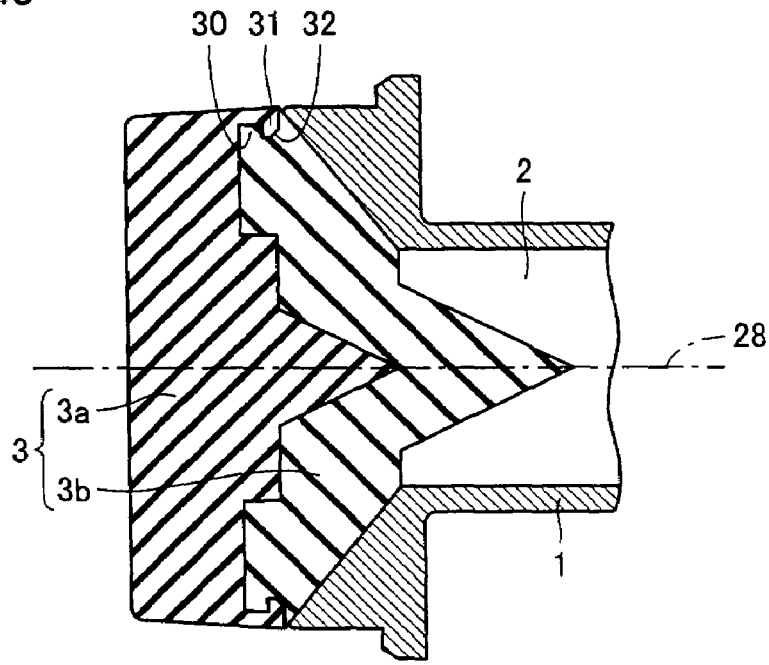
FIG. 9 is a partial cross-sectional illustration showing a front portion of a dielectric feedhorn of a second modification of the converter of the antenna shown in FIGS. 1-3.

Referring to FIG. 9, a converter as a second modification of the first embodiment of the present invention will be described. FIG. 9 corresponds to FIG. 3.

While the converter including a dielectric feedhorn shown in FIG. 9 basically has the same structure as converter 13 of the antenna shown in FIGS. 1-3, they are different in the connection method of dielectrics 3*a* and 3*b*. Specifically, a nail portion 31 is provided to a portion that is an end portion (a rear end) of dielectric 3*a*, and that faces to dielectric 3*b*. In dielectric 3*b*, to a portion that is an end portion of a surface facing to dielectric 3*a* and that faces to nail portion 31 of dielectric 3*a*, a flange portion 30 is formed. In dielectric 3*b*, a concave portion 32 is formed on chassis body 1 side (opposite to the side on which dielectric 3*a* is positioned) as seen from flange portion 30. By concave portion 32 and nail portion 31 of dielectric 3*a* mating with each other, dielectrics 3*a* and 3*b* can be fixedly connected to each other. While such a set of nail portion 31 and concave portion 32 may be provided in a plurality of numbers in a circumferential direction in the outer circumference of dielectric member 3, it is preferable to provide the set of nail portion 31 and concave portion 32 at three or four places with regular intervals in the circumferential direction.

With such a configuration also, the strength of the connection portion between dielectrics 3*a* and 3*b* can stably be maintained high. Additionally, as the adhesion between dielectrics 3*a* and 3*b* can be improved, consequently, the reliability of dielectric member 3 can be increased.

Figure 10:
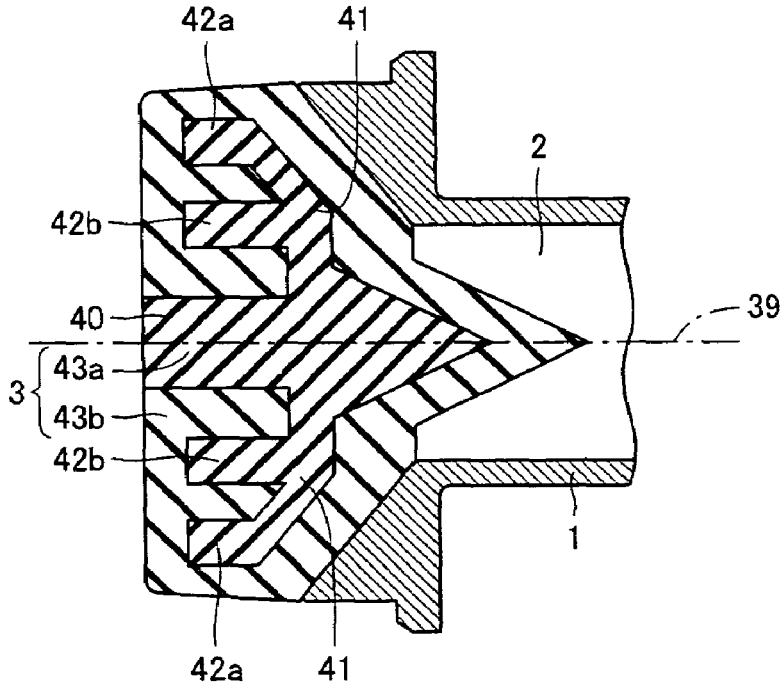
FIG. 10 is a partial cross-sectional illustration showing a front portion of a dielectric feedhorn of a third modification of the converter of the antenna shown in FIGS. 1-3.
Figure 11:
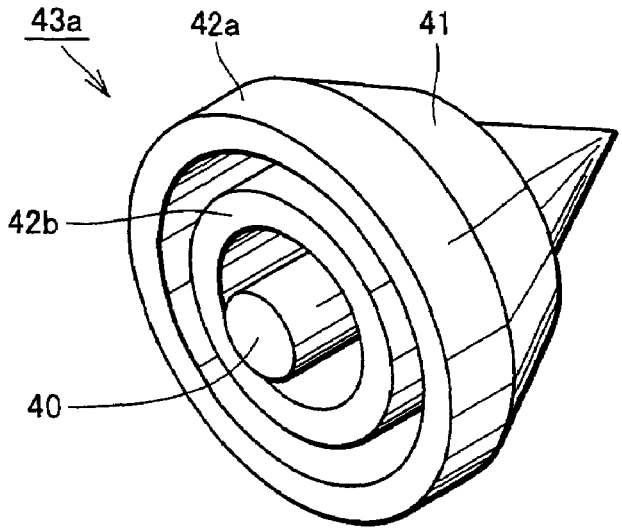
FIG. 11 is a schematic perspective illustration showing a dielectric that is one member constituting the dielectric feedhorn shown in FIG. 10.

Referring to FIGS. 10 and 11, a converter as a third modification of the first embodiment of the present invention will be described.

While the converter of an antenna shown in FIGS. 10 and 11 basically has the same structure as converter 13 of the antenna shown in FIGS. 1-3, they are different in the structure of dielectric member 3. Specifically, dielectric member 3 in the converter shown in FIGS. 10 and 11 is formed of a dielectric 43*a* formed by injection molding in advance, and a dielectric 43*b* molded integrally with dielectric 43*a* so as to surround dielectric 43*a*. Such dielectric member 3 can be obtained by arranging dielectric 43*a* formed in advance inside a mold for forming dielectric member 3, injecting a prescribed resin constituting dielectric 43*b*, and then curing it to form dielectric 43*b*. As a result, dielectric 43*a* is buried in the internal peripheral side of dielectric 43*b* and fixed therein.

As can be seen from FIGS. 10 and 11, dielectric 43*a* is constituted by a bottom wall portion 41 extending from a center axis 39 of a center axis portion 40 to a circumferential direction, and concentric wall portions 42*a* and 42*b* extending from bottom wall portion 41 along the direction in which center axis 39 extends. Since dielectric 43*a* is formed so as to have a shape with concave and convex portions, dielectric 43*b* is fixedly connected to dielectric 43*a* in a state maintaining an excellent adhesion. As a result, adhesion between dielectrics 43*a* and 43*b* is stabilized, and hence the connection strength between dielectrics 43*a* and 43*b* can be maintained high.

Figure 12:
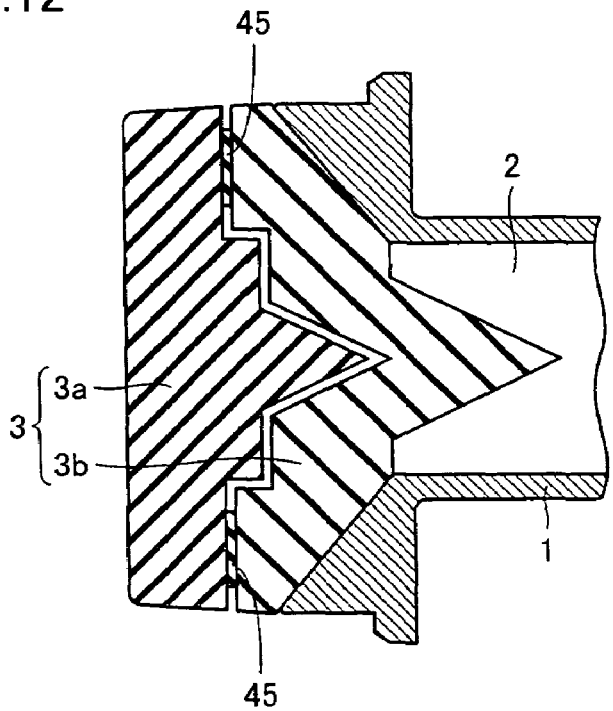
FIG. 12 is a partial cross-sectional illustration showing a front portion of a dielectric feedhorn of a fourth modification of the converter of the antenna according to the present invention shown in FIGS. 1-3.

Referring to FIG. 12, a converter as a fourth modification of the first embodiment of the present invention will be described. FIG. 12 corresponds to FIG. 3.

While the converter shown in FIG. 12 basically has the same structure as converter 13 shown in FIGS. 1-3, they are different in the connection method of dielectrics 3*a* and 3*b*. Specifically, in the converter shown in FIG. 12, dielectrics 3*a* and 3*b* have part of their surfaces that face to each other connected and fixed to each other with a double-faced tape 45. Here, as double-faced tape 45, a product can be employed in which adhesive layers made of an adhesive material are formed to front and back faces of a sheet-like base material made of resin or the like. Such a double-faced tape 45 hardly provides an adverse effect to the characteristics of dielectric member 3, if it is sufficiently thin. For example, double-faced tape 45 of approximately 25 μm thickness can be employed.

Using double-faced tape 45 as above, the connecting step of dielectrics 3*a* and 3*b* can be performed relatively easily.

Second Embodiment

Figure 13:
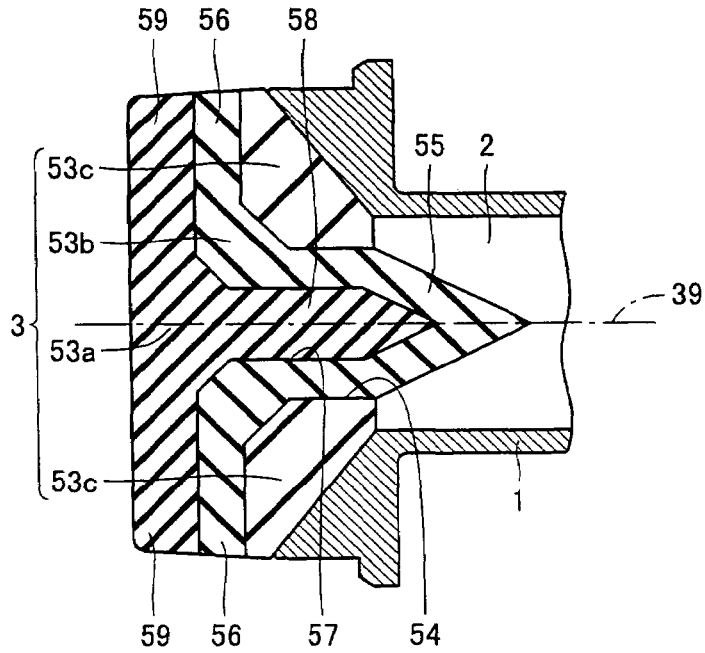
FIG. 13 is a partial cross-sectional illustration showing a front portion of a dielectric feedhorn according to a second embodiment of a converter used in an antenna according to the present invention.

Referring to FIG. 13, a second embodiment of a converter according to the present invention will be described. FIG. 13 corresponds to FIG. 3.

While the converter including a dielectric feedhorn shown in FIG. 13 basically has the same structure as converter 13 shown in FIGS. 1-3, they are different in the structure of dielectric member 3. Specifically, in the converter shown in FIG. 13, dielectric member 3 is constituted by three members of dielectrics 53*a*-53*c*. In particular, dielectric 53*c* has a ring-like shape. Dielectric 53*b* is formed of a center portion 55 that is inserted into a center hole 54 of this ring-like dielectric 53*c*, and a circumferential outer edge portion 56 arranged from this center portion 55 relative to center axis 39 to be spread in a radial manner from center portion 55. Dielectric 53*a* is formed of a center portion 58 that is inserted into a hole 57 formed at a center portion of dielectric 53*b*, and an outer edge portion 59 connected to this center portion 58 and spreads relative to center axis 39 in a radial manner from center portion 58. These dielectrics 53*a*-53*c* may be connected by the same method as the connection method of dielectrics 3*a* and 3*b* described in the first embodiment of the present invention.

As described above, by producing dielectric member 3 separated into three members, moldability of dielectrics 53*a*-

53*c* may be improved similarly to the first embodiment. Accordingly, dielectric member 3 with excellent moldability can be implemented. As a result, yield of dielectric member 3 can be improved, and consequently, the manufacturing costs of the converter and the antenna can be reduced. It should be noted that the number of dielectrics constituting dielectric member 3 may be any number besides two or three as described above (for example, any number at least four).

Summarizing the characteristic configuration of the dielectric feedhorn as one example of the feedhorn according to the present invention described above, the dielectric feedhorn described referring to FIGS. 1-13 includes chassis body 1 including waveguide 2 having an opening, and dielectric member 3. Dielectric member 3 is connected to the opening of waveguide 2, and constituted by dielectrics 3*a* and 3*b* (see FIGS. 2, 3, 5-9, and 12), 43*a* and 43*b* (see FIG. 10), and 53*a*-53*c*, as a plurality of members.

Thus, as compared to the case where dielectric member 33 is constituted by one member as shown in FIG. 14, dimension (size) such as thickness of dielectrics 3*a* and 3*b*, 43*a* and 43*b*, and 53*a*-53*c*, as a plurality of members constituting dielectric member 3 can be made smaller. Accordingly, when manufacturing dielectrics 3*a* and 3*b*, 43*a* and 43*b*, and 53*a*-53*c* using injection molding or the like, probability of occurrence of concave portion 34 (see FIG. 15) on the surface or bubble 35 (see FIG. 15) inside that tends to occur in a thick portion can be reduced (in other words, moldability of dielectric member 3 can be improved). As a result, as manufacturing yield of dielectric member 3 can be improved, an increase in the manufacturing costs of the dielectric feedhorn including dielectric member 3 due to decreased yield of dielectric member 3 is suppressed.

In the dielectric feedhorn described above, to dielectrics 3*a* and 3*b* that are the plurality of members constituting dielectric member 3, a connection portion for connecting the plurality of dielectrics 3*a* and 3*b* to each other may be formed as shown in FIG. 5-9 (for example, a set of convex portion 25 and concave portion 26 as shown in FIGS. 5-8, or a set of nail portion 31 and concave portion 32 as shown in FIG. 9). In this case, a plurality of dielectrics 3*a* and 3*b* can surely be connected to each other using the connection portion. Accordingly, the precision of the shape of dielectric member 3 can be maintained high.

In the dielectric feedhorn described above, the connection portion described above may include convex portion 25 formed at dielectric 3*a* as one member among a plurality of dielectrics 3*a* and 3*b*, and concave portion 26 formed at dielectric 3*b* as another member different from dielectric 3*a* among the plurality of dielectrics 3*a* and 3*b*, as shown in FIGS. 5-8. This concave portion 26 is for inserting and fixing convex portion 25.

In this case, through a simple work of inserting and fixing convex portion 25 formed at dielectric 3*a* as one member into concave portion 26 formed at dielectric 3*b* as another member, dielectrics 3*a* and 3*b* can be joined to each other. Accordingly, as the manufacturing steps of dielectric member 3 can be simplified, the manufacturing costs of the dielectric feedhorn including dielectric member 3, and hence the manufacturing costs of converter 13 can be decreased.

In the dielectric feedhorn described above, the connection portion described above may include nail portion 31 formed at dielectric 3*a* as one member among dielectrics 3*a* and 3*b* as a plurality of members, and concave portion 32 formed at dielectric 3*b* as another member different from dielectric 3*a* among the plurality of dielectrics 3*a* and 3*b*, as shown in FIG. 9. This concave portion 32 is for mating with nail portion 31.

In this case, through a simple work of mating nail portion 31 formed at one dielectric 3*a* with concave portion 32 of another dielectric 3*b*, dielectrics 3*a* and 3*b* can be joined with each other. Accordingly, the manufacturing steps of dielectric member 3 can be simplified.

In the dielectric feedhorn described above, as shown in FIG. 10, dielectric member 3 may include one dielectric 43*a* among dielectrics 43*a* and 43*b* as a plurality of members, and dielectric 43*b* as another member different from dielectric 43*a* among the plurality of dielectrics 43*a* and 43*b*. Dielectric 43*b* is arranged to surround dielectric 43*a* and connected to dielectric 43*a*. In other words, dielectric 43*a* is buried inside dielectric 43*b*.

In this case, as dielectric 43*a* is held (buried) inside dielectric 43*b*, connection between dielectrics 43*a* and 43*b* can surely be performed. In other words, the connection strength between dielectrics 43*a* and 43*b* can be maintained high.

In the dielectric feedhorn described above, as shown in FIG. 12, dielectric member 3 may include dielectric 3*a* as one member among dielectrics 3*a* and 3*b* as a plurality of members, double-faced tape 45 as an adhesion member, and dielectric 3*b* as another member different from dielectric 3*a* among the plurality of dielectrics 3*a*, 3*b*. Double-faced tape 45 as an adhesion member is arranged to a portion, which faces to dielectric 3*b*, of the surface of dielectric 3*a*. Dielectric 3*b* is connected to dielectric 3*a* via double-faced tape 45.

In this case, through a simple step of adhering dielectrics 3*a* and 3*b* by double-faced tape 45, dielectric member 3 can be manufactured. Accordingly, an increase in the manufacturing costs of dielectric member 3 and the dielectric feedhorn including this dielectric member 3, and hence the manufacturing costs of converter 13 or antenna 10 can be suppressed.

Converter 13 as one example of the radio wave receiving converter according to the present invention includes the dielectric feedhorn described above. In other words, converter 13 according to the present invention includes a dielectric feedhorn including chassis body 1 including waveguide 2 having an opening and dielectric member 3. Dielectric member 3 is connected to the opening of waveguide 2, and constituted by dielectrics 3*a* and 3*b*, 43*a* and 43*b*, and 53*a*-53*c* as a plurality of members. Thus, an increase in the manufacturing costs of the dielectric feedhorn is suppressed, and consequently, an increase in the manufacturing costs of converter 13 is suppressed as well.

Antenna 10 according to the present invention includes converter 13 described above. Thus, an increase in the manufacturing costs of converter 13 is suppressed, and consequently, an increase in the manufacturing costs of antenna 10 is suppressed as well.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A feedhorn, comprising:

a chassis body including a waveguide having an opening; and a dielectric member connected to said opening of said waveguide and comprising a plurality of members, wherein said dielectric member comprises a first member, and a second member among said plurality of members that is molded integrally with, and substantially surrounds, said first member, and wherein said first and second members comprise pairs of multiple mutually engaged concave and convex portions.

2. A radio wave receiving converter comprising the feedhorn according to claim 1.

3. An antenna comprising the radio wave receiving converter according to claim 2.

4. The feedhorn according to claim 1, further comprising:

a cover for covering said dielectric member.

5. A feedhorn, comprising:

a chassis body including a waveguide having an opening; and a dielectric member connected to the opening of the waveguide and comprising at least two dielectric members, wherein the dielectric member adjusts a radiation pattern using only the at least two dielectric members, wherein the at least two dielectric members are each formed only of dielectric material, wherein a first dielectric member of the at least two dielectric members comprises multiple wall portions each arranged concentrically with respect to a center axis of the first dielectric member, and wherein a second dielectric member of the at least two dielectric members is molded integrally with, and substantially surrounds, the first dielectric member.

6. The feedhorn according to claim 5, further comprising:

a cover for covering the dielectric member.

7. A radio wave receiving converter comprising the feedhorn according to claim 5.

8. An antenna comprising the radio wave receiving converter according to claim 7.

9. The feed horn according to claim 5, wherein the second dielectric member comprises a connecting portion that extends in a space between two adjacent ones of the multiple wall portions.

10. A feedhorn, comprising:

a chassis body including a waveguide having an opening; and a dielectric member contacting a wall of the opening of the waveguide and comprising at least two dielectric members, wherein a first dielectric member of the at least two dielectric members comprises an axial portion and a wall portion arranged concentrically with respect thereto, and wherein a second dielectric member of the at least two dielectric members substantially surrounds the first dielectric member, the second dielectric member comprising a connecting portion that extends in a space between the axial and wall portions of the first dielectric member.

11. The feedhorn according to claim 10, wherein the first dielectric member comprises a second wall portion arranged concentrically with respect to the first wall portion and the axial portion, and the second dielectric portion comprises another connecting portion that extends in a space between the first and second wall portions of the first dielectric member.

12. The feedhorn according to claim 10, further comprising:

a cover for covering the dielectric member.

13. The feedhorn according to claim 10, wherein the at least two dielectric members are integrally molded resin members.

14. A radio wave receiving converter comprising the feedhorn according to claim 10.

15. An antenna comprising the radio wave receiving converter according to claim 10.

* * * * *